US007435147B1

(12) United States Patent
Eichinger

(10) Patent No.: US 7,435,147 B1
(45) Date of Patent: Oct. 14, 2008

(54) BREAKAWAY SKEG FOR A MARINE PROPULSION DEVICE

(75) Inventor: Charles H. Eichinger, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/811,030

(22) Filed: Jun. 8, 2007

(51) Int. Cl.
*B63H 20/34* (2006.01)

(52) U.S. Cl. ..... 440/78; 114/127; 114/140; 441/79

(58) Field of Classification Search ..... 114/127, 114/140; 440/78; 441/79
See application file for complete search history.

(56) References Cited

U.S. PATENT DOCUMENTS

| | | | | |
|---|---|---|---|---|
| 4,398,485 | A * | 8/1983 | Diziere | 114/132 |
| 4,701,144 | A * | 10/1987 | DeWitt, III | 441/79 |
| 4,964,826 | A * | 10/1990 | Lobe | 441/79 |
| 4,995,840 | A | 2/1991 | Seale et al. | 440/66 |
| 5,007,868 | A * | 4/1991 | Fry | 440/71 |
| 5,007,869 | A | 4/1991 | Zoellner | 440/71 |
| 5,018,997 | A | 5/1991 | Guptill | 440/76 |
| 5,277,632 | A | 1/1994 | Davis | 440/71 |
| 5,772,481 | A | 6/1998 | Alexander et al. | 440/66 |
| 6,503,110 | B2 | 1/2003 | Lammli | 440/71 |
| 6,966,806 | B1 | 11/2005 | Bruestle et al. | 440/78 |
| 7,029,352 | B1 * | 4/2006 | Suzuki | 441/79 |
| 7,188,581 | B1 | 3/2007 | Davis et al. | 114/285 |

FOREIGN PATENT DOCUMENTS

EP 1 044 874 A2 * 10/2000

* cited by examiner

*Primary Examiner*—Sherman Basinger
(74) *Attorney, Agent, or Firm*—Wiilam D. Lanyi

(57) ABSTRACT

A marine propulsion device is provided with a breakaway skeg having first and second attachment points. The first and second attachment points are configured to result in the second attachment points disengaging from a gear case or housing structure prior to the first attachment point. The attachment points can comprise open or closed slots and, when an open slot is used for the first attachment point, it can be provided with a first edge along which a first pin can exert a force along a preselected angle in response to an impact force on the skeg. The arrangement of attachment points allows a reaction force at the second pin to be predetermined in a way that assures the detachment of the skeg from the housing structure prior to the detachment of the housing structure from another structure, such as the boat hull, or transom.

12 Claims, 5 Drawing Sheets

BREAKAWAY SKEG FOR A MARINE PROPULSION DEVICE

BACKGROUND OF THE INVENTION

1. Field of the Invention

The present invention is generally related to a breakaway skeg and, more particularly, to a system for attaching a skeg to a housing structure in a manner that causes attachment points to sequentially disengage so that the moment caused by an impact force needed to separate the skeg from the housing structure can be accurately preselected.

2. Description of the Related Art

Those skilled in the art of marine propulsion devices are familiar with many types of attachment techniques that are intended to be used in conjunction with skegs. Some attachments are intended to provide desirable maneuvering capability while others are intended to physically protect the skeg from damage. Other techniques are known for the purpose of allowing a skeg to breakaway, in a sacrificial manner, in order to protect the marine propulsion device from more serious damage.

U.S. Pat. No. 4,995,840, which issued to Seale et al. on Feb. 26, 1991, describes a stabilizing fin for a motorboat. It is provided with a thickened trailing edge in order to act as a flap for inducing drag during startup. The induced drag serves to minimize the time within which the fin moves into a planing position. The recess on the bottom surface of the fin enhances the lifting force on the fin during stabilization without imposing undue drag forces during high speed travel of a boat.

U.S. Pat. No. 5,007,868, which issued to Fry on Apr. 16, 1991, describes a replaceable skeg for a marine propulsion device. It includes a tapered dovetail tongue and groove joint between top of the skeg and lower portion of a gear case housing on the marine propulsion device. When the skeg is hit by an underwater obstruction it will fracture at the joint and break away, leaving the lower portion of the gear case housing in tact and undamaged in which another skeg can be installed thereto.

U.S. Pat. No. 5,007,869, which issued to Zoellner on Apr. 16, 1991, describes a propeller guard device. It includes a laterally extending fin and a vertical extension or sleeve. The fin and sleeve could be manufactured as a single item. The vertical sleeve is attached to the midline area of the fin with the leading edge of the sleeve being generally coterminous with the leading edge of the fin. The fin is at least as wide as the rotational path of the propeller blades. The singular fin extends laterally on either side of the sleeve in a generally coplanar relationship. The leading edge of the fin is elevated from three to five degrees higher than the trailing edge of the fin. The trailing edge of the fin is located forwardly of the rotational path of the propeller blades or is lengthened and extends towards the rear of the device to the extent of being even with the midline of the rotational path of the propeller blades.

U.S. Pat. No. 5,018,997, which issued to Guptill on May 28, 1991, describes a skeg protector. It is mounted on the leading edge of the skeg of a boat motor. The protector is in the form of a channel of stainless steel fitted on the skeg with the base of the channel spaced forwardly of the leading edge of the skeg. A rubber strip extends along the inside of the channel. To mount the protector on the skeg, elongate, horizontal slots are formed in the channel flanges and holes are drilled through the skeg in line with the slots. Dome head machine screws and nuts are fastened through the slots and the bores of the skeg. These slots allow the skeg protector to yield somewhat on impact with a submerged object.

U.S. Pat. No. 5,277,632, which issued to Davis on Jan. 11, 1994, describes a boat motor replacement skeg. The skeg is thin and flat and has a cavity formed in one of its edges. The replacement skeg is slid over the stub which remains after the original skeg is broken off, and is fastened to the skeg stub with silicone sealant and rivets. As an alternative, the replacement skeg may be part of an original design to replace a specific breakaway skeg having a particular mounting structure.

U.S. Pat. No. 5,772,481, which issued to Alexander et al. on Jun. 30, 1998, discloses a skeg construction for a marine propulsion unit. A skeg assembly for a marine propulsion unit includes a generally U-shaped saddle that is removably attached to the lower torpedo section of the gear case of the propulsion unit and a thin wedge-shaped skeg extends downwardly from the saddle. During planing conditions of the boat, the water line is slightly below the lower torpedo section so that the saddle is out of the water. The side surfaces of the skeg have opposed water intake openings each of which is bordered rearwardly by a laterally projecting shoulder that terminates in a sharp vertical edge and the intake openings are bordered forwardly by a curved surface that connects the side surfaces of the skeg. The water intake openings communicate with a water passage in the skeg which, in turn, communicates with a water passage in the torpedo section so that water can be delivered to the cooling system of the propulsion unit.

U.S. Pat. No. 6,503,110, which issued to Lammli on Jan. 7, 2003, describes a lower unit guard for an outboard motor. It includes a mounting adapter to be secured onto a flange on a housing of a boat motor. The mounting has a leading edge. A skeg receiving pocket is provided which is adapted to receive a skeg of the boat motor. The skeg receiving pocket is adapted to accommodate in close fitting relation the skeg in its entirety. The skeg receiving pocket has a leading edge, a trailing edge, and a bottom edge. A reinforcement member is adapted to fit the contours of a lower unit of a boat motor. The reinforcement member has an upper extremity secured to the leading edge of the mounting and a lower extremity secured to the leading edge of the skeg receiving pocket.

U.S. Pat. No. 6,966,806, which issued to Bruestle et al. on Nov. 22, 2005, discloses a replaceable leading edge for a marine drive unit. A marine propulsion device is made of first and second portions which are removably attachable to each other. The second portion is the leading edge portion of the nose cone and the driveshaft housing. It can also comprise a portion of the skeg. The second portion is configured to crush more easily in response to an impact force from the first portion. This can be accomplished by making the second portion from a different material than the first portion, which can be aluminum, or by providing one or more crush boxes within the structure of the of the second portion to cause it to yield more quickly to an impact force and thus protect the first portion which is the more critical structure of the marine device.

U.S. Pat. No. 7,188,581, which issued to Davis et al. on Mar. 13, 2007, discloses a marine drive with integrated trim tab. The marine drive and the marine vessel are disclosed in which the drive combination has a trim tab with a forward end pivotally mounted to a marine propulsion device.

The patents described above are hereby expressly incorporated by reference in the description of the present invention.

The concept of having a breakaway skeg attached to a gear case of a marine propulsion device is very well known to those skilled in the art. As described above, breakaway and replacement skegs of many different types and designs are known. However, in recent years, marine propulsion devices have been developed in which it has become advantageous to be able to more precisely determine the force and resulting moment that is necessary to cause a skeg to be detached from its associated gear case. Breakaway skegs have always been intended to avoid more serious damage to the marine propulsion drive unit. The purpose of a breakaway skeg is to allow it to be sacrificed before damage can occur to the marine drive unit. However, certain types of marine propulsion devices can benefit significantly if the moment necessary to separate the skeg can be more accurately predetermined. It would therefore be significantly beneficial if a breakaway skeg could be provided which allows the accurate predetermination of the breakaway moment.

SUMMARY OF THE INVENTION

A marine propulsion device made in accordance with a preferred embodiment of the present invention comprises a housing structure, a skeg, and first and second attachment points between the housing structure and the skeg in which the attachment points are configured to cause the first attachment point to disengage prior to the second attachment point in response to a force exerted against the skeg. The first and second attachment points can be configured to cause the second attachment point to fracture prior to the first attachment point in response to the force exerted against the skeg. The first and second attachment points can comprise first and second pins disposed in first and second slots, respectively. The first pin can be attached to the housing structure and the first slot can extend through a portion of the skeg in certain embodiments of the present invention. The first slot can be a closed slot or an open slot.

In a preferred embodiment of the present invention, the first and second attachment points are configured to cause the second attachment point to completely disengage prior to the first attachment point in response to the force exerted against the skeg. If an open slot is used in an embodiment of the present invention, the first pin can be configured to move out of the first slot in response to the force exerted against the skeg. The first slot can be configured to allow the first pin to slide along a first edge of the first slot prior to and during the disengagement process. The first and second pins can be disposed along a pin line and the first edge is disposed at an angle to the pin line which is selected to cause a preselected resultant force on the second pin in response to the force exerted against the skeg.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
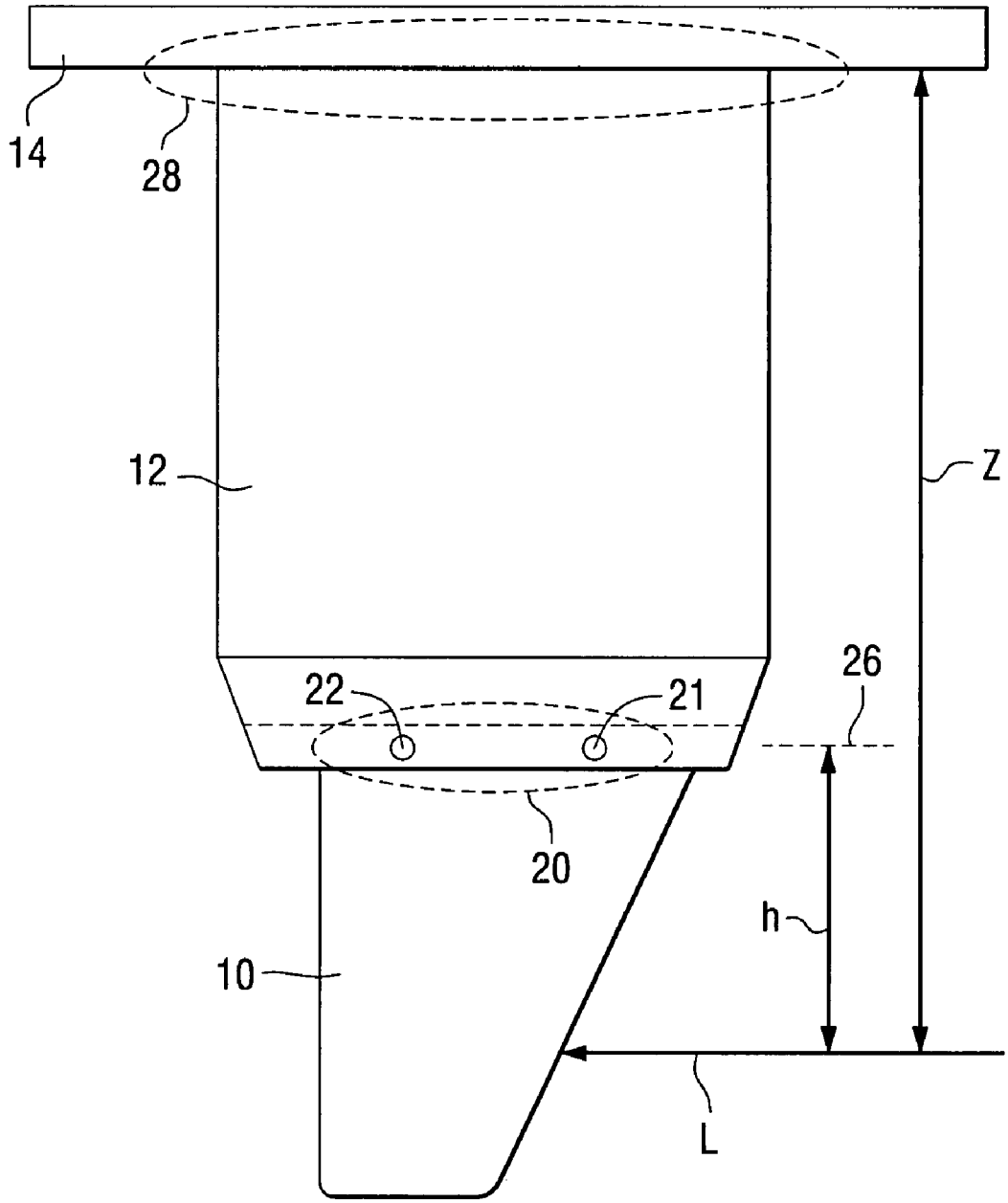
FIG. 1 is a schematic representation of a breakaway skeg attached to a housing structure which is attached to another structure.

Throughout the description of the preferred embodiment of the present invention, like components will be identified by like reference numerals.

FIG. 1 is a highly schematic representation of a skeg 10 attached to a housing structure 12, such as a gear case or a driveshaft housing. The housing structure 12, in turn, is attached to a fixed structure 14 which can be the underside of a boat hull or, in alternative applications, the transom of a marine vessel. Those skilled in the art will appreciate that the configuration shown in FIG. 1 illustrates the housing structure 12 attached to a generally horizontal structure which signifies the underside of a boat hull. An alternative configuration, wherein the housing structure 12 is attached to the transom of a marine vessel, would provide for an attachment to a structure located toward the right of the housing structure 12 in FIG. 1. It should be understood that the particular type of attachment between the housing structure 12 and the structure 14 is not limiting to the present invention. In the region identified by dashed line oval 20, first and second attachment points, 21 and 22, are illustrated. These attachment points can typically be bolts, rivets, or shear pins. They are generally configured to allow a breakaway skeg 10 to be disengaged from its attachment to the housing structure 12.

With continued reference to FIG. 1, arrow L represents an impact force that is exerted on the skeg 10 when the skeg strikes a submerged object. Although it is recognized that the force L can occur at alternative locations along the total height of the housing structure 12 and skeg 10, it is shown at a hypothetical location for purposes of the description of the goals and functions of the present invention. The force L is shown at a distance h below a pin line 26. The first and second attachment points, 21 and 22, are co-linear with the pin line 26. Dimension Z represents the distance between the force L and a region 28, represented by a dashed line oval, where a sufficient moment can possibly result in the detachment between the housing structure 12 and the structure 14. As described above, the housing structure 12 can alternatively be attached to a generally vertical transom of a marine vessel at the surface on the right side of the housing structure 12 in FIG. 1. In that type of alternative application, dimension Z would, of course, extend from the force L to the effective point at which a resulting moment would be effective. In essence, dimension Z represents a moment arm about region 28 and dimension h represents a moment arm about region 20 resulting from force L.

In U.S. Pat. No. 7,188,581, described above, marine propulsion devices extend downwardly from a generally horizontal surface of a boat hull. Alternatively, the housing structure 12 can be the gear case and driveshaft housing of a sterndrive unit such as those which are well known to those skilled in the art of marine propulsion devices. When a replaceable skeg 10 is used in conjunction with a drive unit that can be detached from a structure such as the one identified by reference numeral 14 in FIG. 1, it is important that the skeg 10 be detachable from the housing structure 12 as a result of a moment about region 20 that is less than the moment necessary to detach the housing structure 12 from structure 14 at region 28. Otherwise, the housing structure 12 will be detached from the hull of a boat prior to or simultaneous with the detachment of the skeg 10 from the housing structure 12 and the resulting damage would be much more severe and costly than would otherwise be the case if the replaceable skeg 10 operated properly and detached prior to any damage to the apparatus at region 28.

Figure 2:
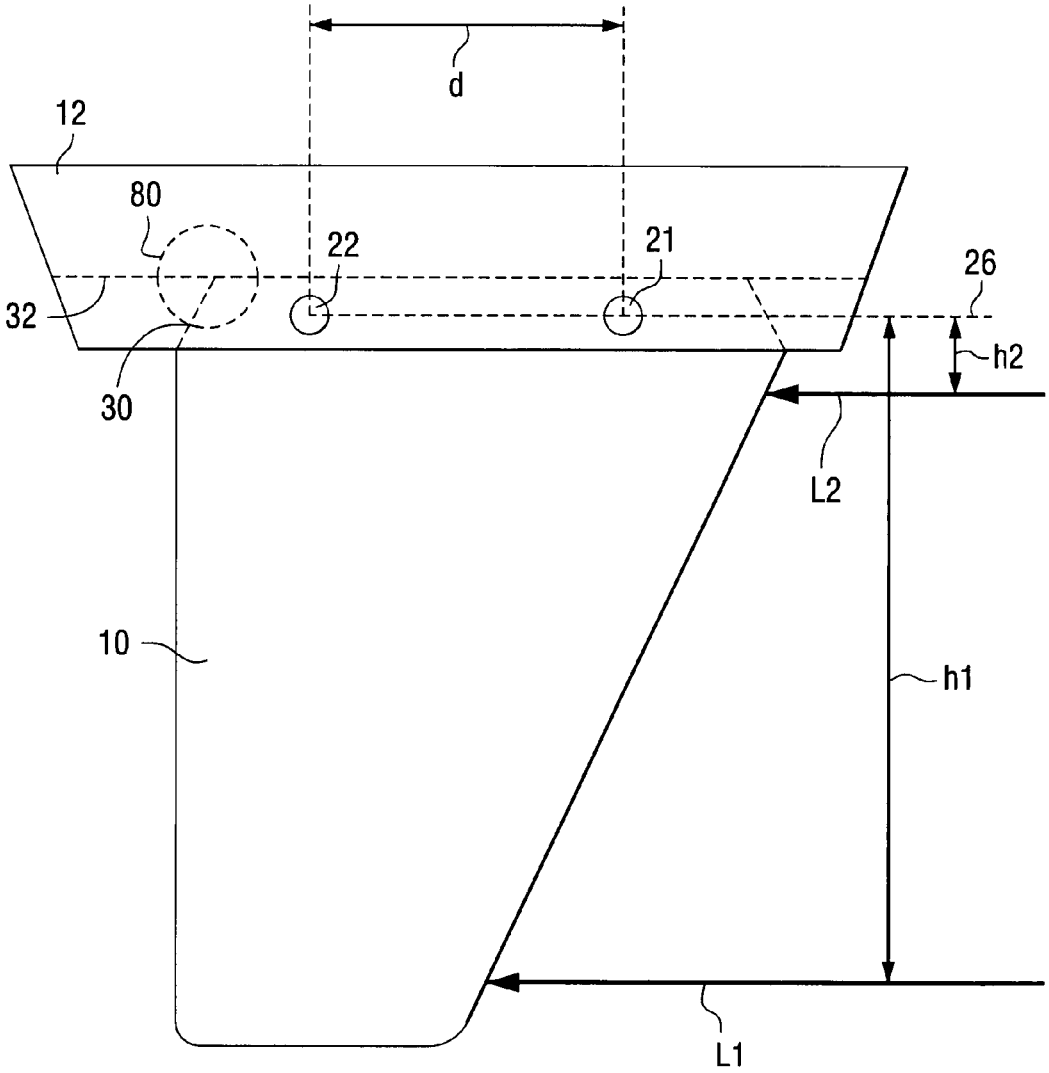
FIG. 2 is a partial view of the device illustrated in FIG. 1.

FIG. 2 is a schematic representation of a portion of the device shown in FIG. 1. The skeg 10 is attached to the housing structure 12 at first and second attachment points, 21 and 22, as described above. The upper portion 30 of the skeg is disposed in a slot 32, or groove, formed in the lower portion of the housing structure 12. As described above, the housing structure 12 can be a gear case and/or driveshaft housing of a marine propulsion device. The tongue, identified by reference numeral 30, of the skeg 10 fits in the groove 32 of the housing structure 12. In FIG. 2, the groove extends along the full length of the housing structure 12 and, except for the restriction provided by the first and second attachment points, 21 and 22, is free to slide into or out of the groove 32 in the illustration shown in FIG. 2. The pin line 26 extends through the first and second attachment points. Two hypothetical forces, L1 and L2, are illustrated in FIG. 2. They are associated with moment arms h1 and h2, respectively, as shown.

With reference to FIGS. 1 and 2, if the attachment points are provided as bolts or shear pins disposed through generally circular openings of approximately the same diameter as the pins, both of the attachment points operate generally simultaneously to resist the effects of any moment caused by the force L operating at a moment arm h. In other words, both attachment points, 21 and 22, cooperate to resist the effective moment caused by the force against the skeg 10. When the force, L1 or L2, is exerted against the skeg 10, the pins of the first and second attachment points, 21 and 22, are subject to several effects. One is the shearing force caused directly by the force against the skeg 10 which operates generally along the pin line 26. In addition, the moment resulting from the force will induce the skeg 10 to rotate in a generally clockwise direction. As a result, an additional resulting force is exerted on a second pin of attachment point 21 to a greater effect than on the first pin at attachment point 22. It is necessary to assure that the force, L1 or L2, will provide a moment which is effective to separate the skeg 10 from the housing structure 12 before the housing structure is separated from the structure 14, such as a boat hull. This is particularly important when the force is exerted against the skeg at a position very low on the skeg. This increases the moment arm h, but it also increases the moment arm z, as shown in FIG. 1. The resultant forces on the pins must therefore be high to result in fracture prior to separation of the housing structure from the hull. Dimension d illustrates the distance between the two pins of the first and second attachment points, 21 and 22. It can be seen that a greater total reaction force will be exerted on the first pin 21 than the second pin 22 but, since both pins operate simultaneously to resist the force exerted against the skeg 10, and the two pins can be expected to yield in different manners as the force is exerted, it is necessary to predetermine the magnitude of the force on the skeg or its position which will disengage the skeg 10 from the housing structure 12.

Figure 3:
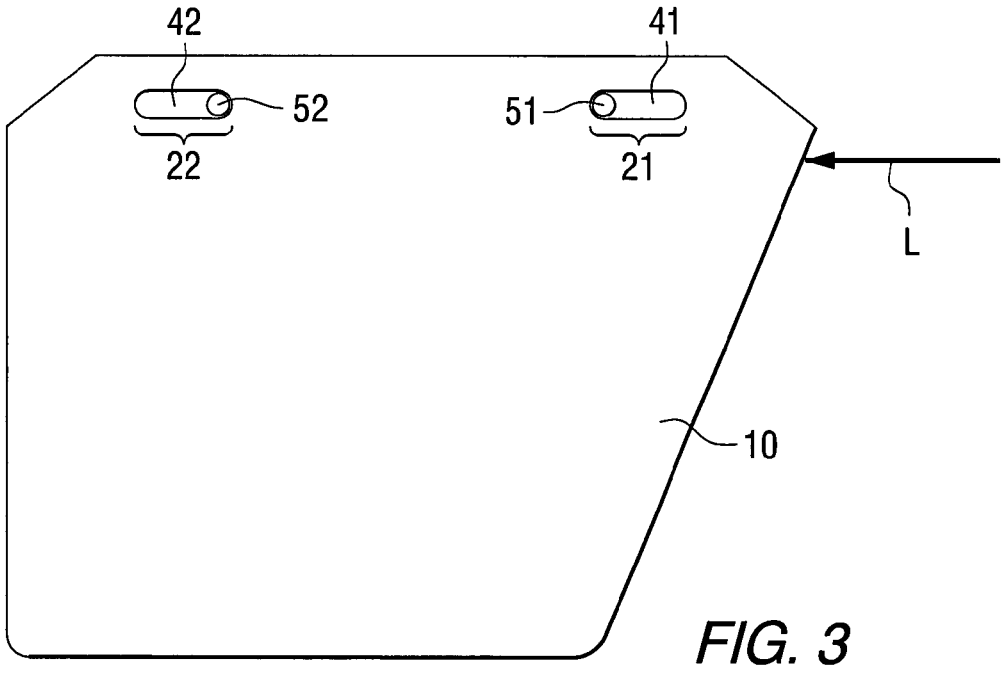
FIG. 3 shows a skeg having two slots and two pins for attaching it to a housing structure.

FIG. 3 shows a skeg 10. For purposes of simplicity, the housing structure 12 is not illustrated in FIG. 3, but the two attachment points, 21 and 22, are illustrated. In the embodiment shown in FIG. 3, the first attachment point 21 comprises a first slot 41 with a first pin 51 disposed therein. The second attachment point 22 comprises a second slot 42 with a second pin 52 disposed therein. The first and second slots, 41 and 42, are oblong in shape and the pins, 51 and 52, extend through their associated slots to be attached to a housing structure such as the one identified by FIG. 12 in FIGS. 1 and 2. It can be seen that the first pin 51 is located at the leftmost portion of the first slot 41 while the second pin 52 is located at the rightmost portion of the second slot 42. As a result, when a force L is exerted against the skeg 10, the total reaction force will be provided by the second pin 52. The first pin 51 will not react to the force L until after pin 52 does. It should be apparent that locating the first and second pins, 51 and 52, at the opposite ends of their respective slots, 41 and 42, will have a similar effect of causing the first pin 51 to absorb the total effect of force L prior to pin 52. The slots, 41 and 42, are closed slots and will result in a shearing of one or both pins, 51 and 52, if the force L is sufficient. This will result in the disengagement of the skeg 10 from its associated housing structure to which the first and second pins were attached.

Figure 4:
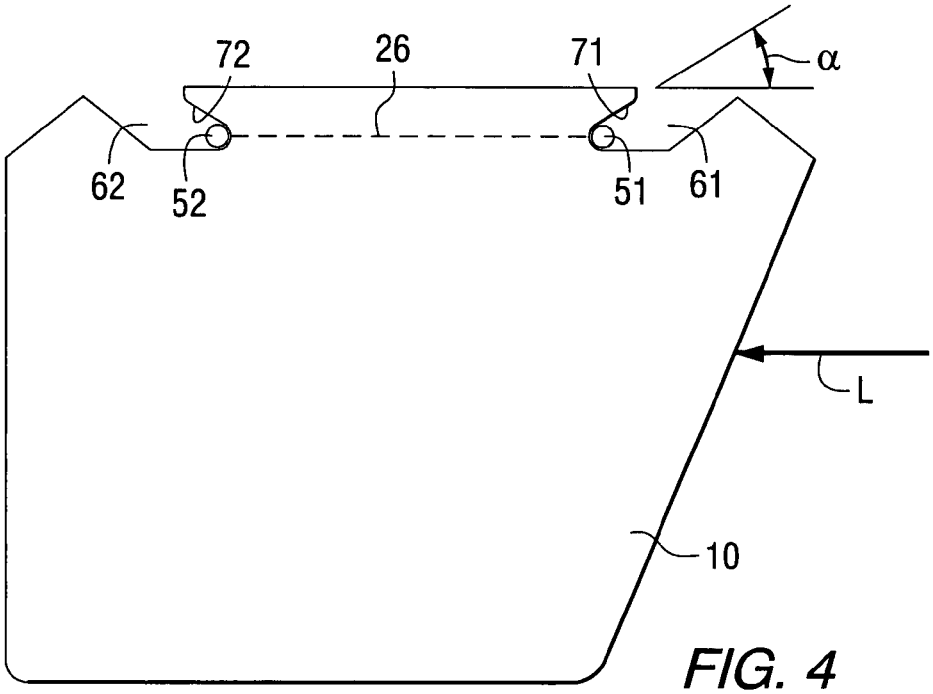
FIG. 4 shows a skeg with two open slots and pins disposed in those open slots.

FIG. 4 is generally similar to FIG. 3, but the first and second pins, 51 and 52, are disposed in first and second slots, 61 and 62, which are open unlike the closed slots, 41 and 42, illustrated in FIG. 3. With particular reference to the first slot 61 in FIG. 4, it is provided with a first edge 71 which is disposed at an angle α to the pin line 26. When a force L is applied to the skeg 10, the skeg will initially rotate about the second pin 52 in most embodiments. As this rotation of the skeg 10 occurs, pin 51 may slide along the first edge 71 as it moves out of the first slot 61, but its reaction force will be perpendicular to the first edge 71.

Figure 5:
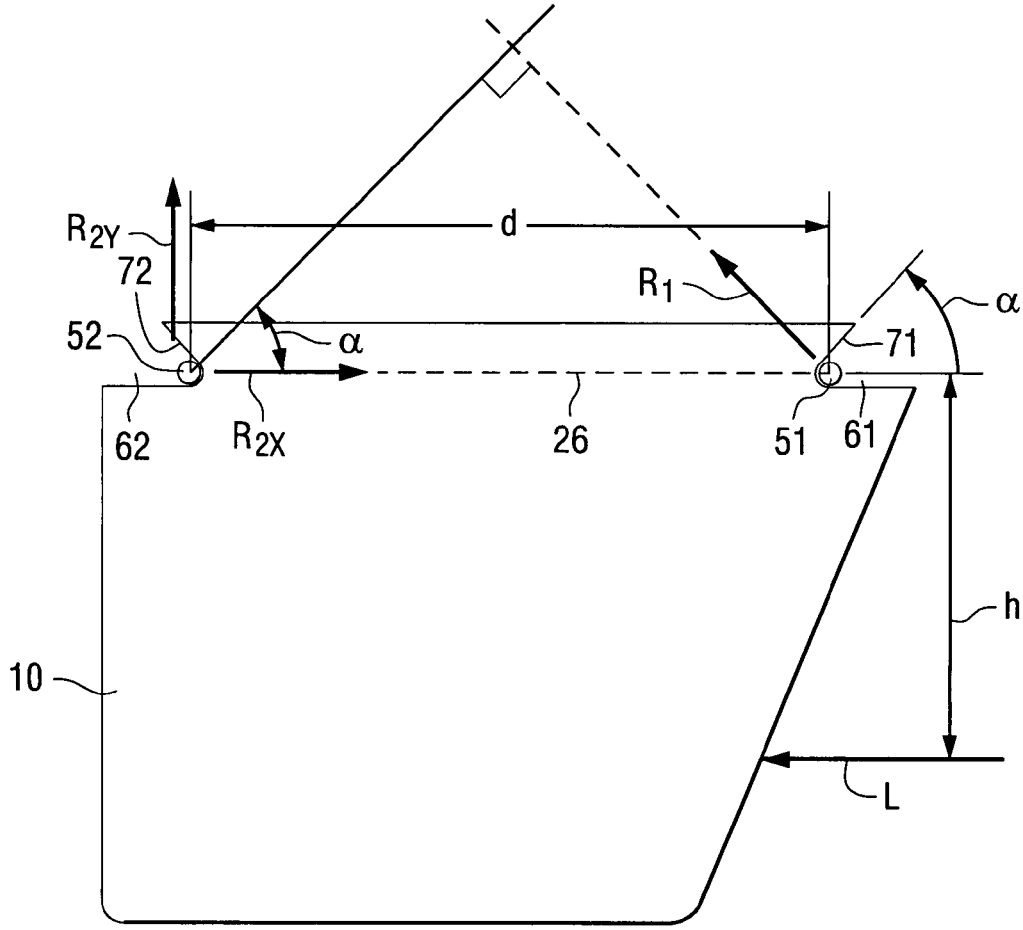
FIG. 5 is a schematic representation of a skeg and two pins.

FIG. 5 is a simplified schematic representation of the skeg 10 shown in FIG. 4. In addition, certain additional reaction forces are illustrated as arrows in FIG. 5. For purposes of the following discussion, it shall be assumed that a force L is exerted on the skeg 10 at a dimension h from the pin line 26. Dimension d is the distance between the first and second pins, 51 and 52. The first edge 71 is disposed at an angle α from the pin line 26. Equation 1, shown below, describes the sum of the moments about the second pin 52. Equation 2 is derived from equation 1 to define the magnitude of the reaction force $R_1$ in terms of the magnitudes of L, h, d, and angle α.

$$\Sigma M_2=0=-Lh+(d)(\sin(90-\alpha))+R_{2X} \quad (1)$$

$$R_1=Lh/(d)(\sin(90-\alpha)) \quad (2)$$

With continued reference to FIG. 5, equations 3 and 4 are derived from the information shown in FIG. 5 as a result of the sums of the forces in the X and Y directions being equal to zero. It should be understood that the force $R_1$ between the first pin 51 and the first edge 71 is perpendicular to the first edge. In addition, the construction line extending from the second pin 52 to meet the construction line co-linear with reaction force $R_1$ are perpendicular to each other.

$$R_{2X}=(R_1)(\cos(90-\alpha))+L \quad (3)$$

$$R_{2Y}=(R_1)(\sin(90-\alpha)) \quad (4)$$

Equations 1-4 allow the reaction force at the second pin 52 to be determined as a function of L, h, d and α. This facilitates the failure of the second pin 52 at a force which can be adjusted and selected to satisfy a target load. Failing one pin at a time allows reasonably large pins and openings to be used. This facilitates manufacture and servicing. This, in turn, allows the failure of the second pin 52 to be predicted with greater accuracy, as a function of the moment on the skeg 10, than would otherwise be possible. This allows the shear strength of the second pin to be selected to assure that the skeg 10 is disengaged from the housing structure 12 at a lesser force L than is necessary to detach the housing structure 12 from structure 14, at region 28, as described above in conjunction with FIG. 1.

With continued reference to FIGS. 1-5, it should be understood that certain configurations used to attach breakaway skegs 10 to housing structures 12, such as gear cases, can result in other contacts between the upper portion of the skeg and the lower portion of the housing structure. In other words, although the tongue 30 and groove 32 are described above in conjunction with FIG. 2 in terms of an open ended groove 32, the forward and rear portions of the tongue 30 can alternatively be constructed to be in contact with end surfaces within the groove 32. This type of construction will naturally lead to additional contact points between the skeg 10 and housing structure 12 other than those described above. In addition, FIG. 2 shows a structure where the upper surface of the tongue 30 is in contact with the upper portion of the groove 32 at a location to the left of the second attachment point 22. This region is identified by dashed line circle 80. As a result, a reaction force on the upper left portion of the skeg 10 will exist in response to a force L exerted on the skeg. In addition, certain frictional forces can be exerted on the skeg, as reaction to the force L, by its contact with the housing structure 12. Therefore, those skilled in the art will recognize that other reaction forces, in addition to those acting through the first and second pins, can occur in response to the exertion of a force L on the skeg 10. However, those forces can be determined by the process of summing the forces and moments about a selected point and can therefore be solved in the general manner described above. It should be understood that the scope of the present invention is not limited to the specific types of contact between the skeg and the housing structure other than the contact at the first and second attachment points, 21 and 22.

Figure 6:
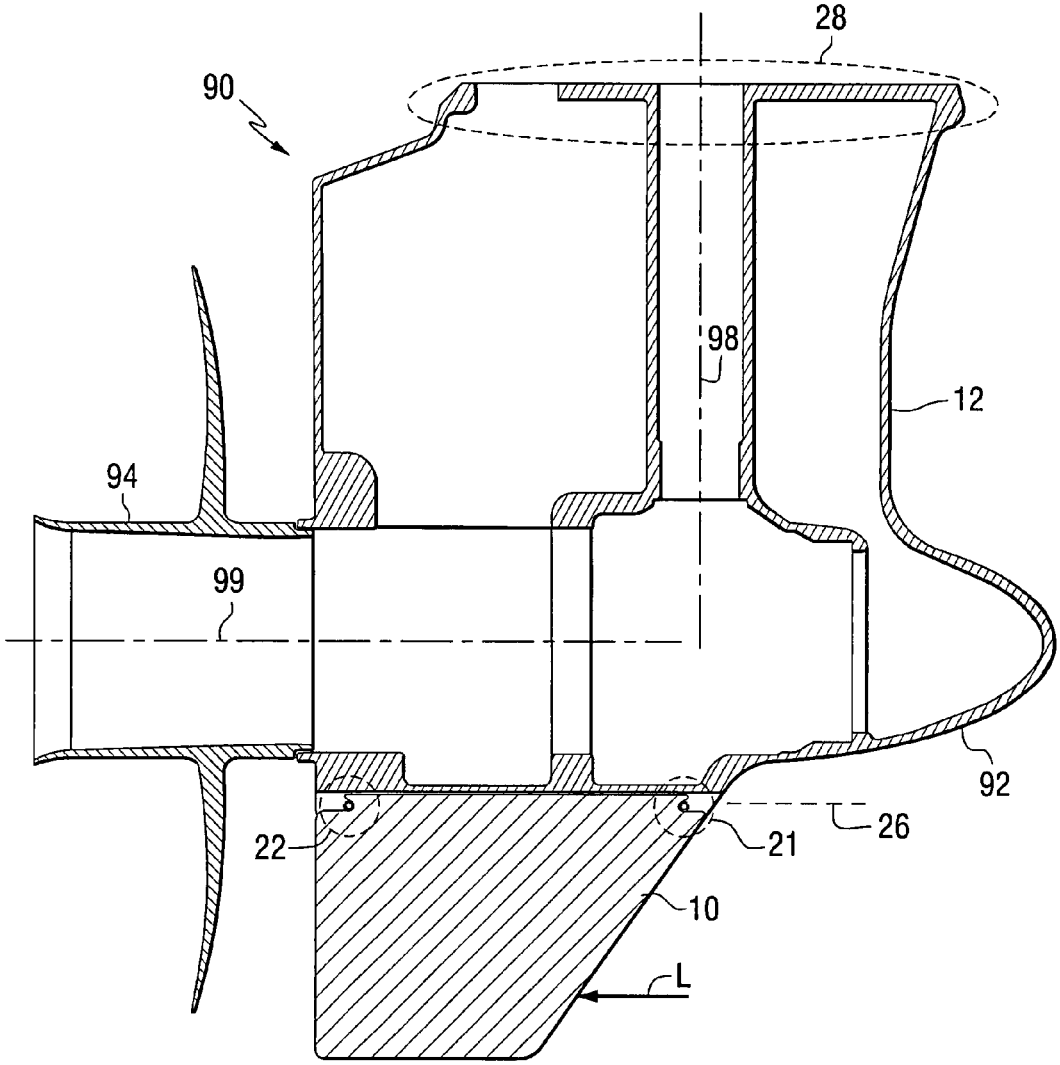
FIG. 6 is a side section view of a marine propulsion device incorporating the concepts of a preferred embodiment of the present invention.

FIG. 6 is a side section view of a marine propulsion device 90 showing the relative positions of the skeg 10, the housing structure 12, a gear case 92 and, for purposes of reference, a propeller 94. The housing structure 12 shown in FIG. 6 is of the type that is attached to the underside of a boat hull. Therefore, as described above in conjunction with FIG. 1, if the marine propulsion device 90 strikes a submerged object, it is possible that the total marine propulsion device can separate from the marine vessel at the area identified by dashed line oval 28. The breakaway skeg 10, as described above in detail, is designed to disengage from the housing structure 12 at a predetermined force L and dimension h that results in a moment that exceeds a predetermined magnitude. In other words, the present invention is intended to assure that the breakaway skeg 10 disengages from the gear case housing 92 prior to disengagement of the housing structure 12 from a marine vessel at the location identified as area 28 in FIGS. 1 and 6. The first and second attachment points, 21 and 22, are shown in FIG. 6.

It should be understood that the purpose of FIG. 6 is to show the relative positions of the components of the present invention in a side section view which more precisely represents the structure of a marine propulsion device in a manner that is less schematic than the illustrations shown in FIGS. 1-5. For purposes of clarity, the driveshaft, which is supported vertically for rotation about axis 98, the propeller shaft which is supported for horizontal rotation about axis 99, and the related gears that connect the propeller 94 in torque transmitting relation with the driveshaft are not shown in FIG. 6.

The present invention allows the reaction force at the second attachment point 21 to be predetermined in order to assure that the second pin will fail, in response to a force L on the skeg 10, prior to a failure at the region 28 between the housing structure 12 and a fixed structure 14, such as the hull of a boat. Naturally, the predetermination of the reaction force at the second pin 52 depends on the dimensions identified by reference characters h, d, $\alpha$, and z. If the moment required to cause a failure at region 28 is determined, the strength of the second pin 22 can be selected as a function of dimension d and the potential range of dimensions h and z, to assure that it fails and results in a disengagement of the skeg 10 before damage is done at the region identified by reference numeral 28. The selection of angle $\alpha$ between the first edge 71 and the pin line 26 permits the skeg design to be selected to achieve a desired relationship between the moment which causes disengagement of the skeg 10 from the housing structure 12 to the moment which causes a failure between the housing structure 12 and the structure 14 in the region identified by reference numeral 28. In addition, the present invention results in the isolation of predictable reaction forces at the second pin 52 and the sequential disengagement of one attachment point before the other.

With continued reference to FIGS. 1-6, it can be seen that a marine propulsion device made in accordance with a preferred embodiment of the present invention comprises a housing structure 12, a skeg 10, a first attachment point 21 between the housing structure 12 and the skeg 10 and a second attachment point 22 between the housing structure 12 and the skeg 10. The first and second attachment points, 21 and 22, are configured to cause the second attachment point 22 to disengage prior to the first attachment point 21 in response to a force L exerted against the skeg 10. The first and second attachment points are configured to cause the second attachment point 22 to fracture prior to the first attachment point 21, in a preferred embodiment of the present invention, in response to the force L exerted against the skeg. The first attachment point 21 comprises a first pin 51 disposed in a first slot 61 and the second attachment point 22 comprises a second pin 52 disposed in a second slot 62 in a preferred embodiment of the present invention. The first pin can be attached to the housing structure 12 and the first slot can extend through a portion of the skeg 10. In alternative embodiments of the present invention, the first and/or second slots can be closed slots. The first and second attachment points, 21 and 22, can be configured to cause the second attachment point 22 to completely disengage prior to the first attachment point 21 in response to the force L exerted against the skeg 10. The first pin 51 can be configured to move out of the first slot 61 in response to the force L exerted against the skeg. The first slot 61 can be configured to allow the first pin 51 to slide along a first edge 71 of the first slot 61. The first and second pins, 51 and 52, can be disposed along a pin line 26 and the first edge 71 can be disposed at an angle $\alpha$ to the pin line 26 which is selected to cause a preselected resultant force on the second pin 52 in response to the force L exerted against the skeg 10.

Although the present invention has been described in particular detail and illustrated to show a preferred embodiment, it should be understood that alternative embodiments are also within its scope.

I claim:

1. A marine propulsion device, comprising:

a housing structure;

a skeg;

a first attachment point between said housing structure and said skeg; and a second attachment point between said housing structure and said skeg, said first and second attachment points being configured to cause said second attachment point to disengage prior to said first attachment point in response to a force exerted against said skeg, said first and second attachment points being configured to cause said second attachment point to fracture prior to said first attachment point in response to said force exerted against said skeg, said first attachment point comprising a first pin disposed in a first slot and said second attachment point comprising a second pin disposed in a second slot, said first pin being attached to said housing structure, said first slot extending through a portion of said skew.

2. The propulsion device of claim 1, wherein:

said first slot is a closed slot.

3. The propulsion device of claim 1, wherein:

said first and second attachment points being configured to cause said second attachment point to completely disengage prior to said first attachment point in response to said force exerted against said skeg.

4. The propulsion device of claim 1, wherein:

said first pin is configured to move out of said first slot in response to said force exerted against said skeg.

5. The propulsion device of claim 4, wherein:

said first slot is configured to allow said first pin to slide along a first edge of said first slot.

6. The propulsion device of claim 5, wherein:

said first and second pins are disposed along a pin line and said first edge is disposed at an angle to said pin line which is selected to cause a preselected resultant force on said second pin in response to said force exerted against said skeg.

7. A marine propulsion device, comprising:

a gear case;

a skeg;

a first attachment point connecting said gear case to said skeg; and a second attachment point connecting said gear case to said skeg, said first and second attachment points being configured to cause said second attachment point to disengage prior to said first attachment point in response to a force exerted against said skeg, said first attachment point comprising a first pin disposed in a first slot said second attachment point comprising a second pin disposed in a second slot, said first slot being configured to allow said first pin to slide along a first edge of said first slot, said first and second pins being disposed along a pin line and said first edge being disposed at an angle to said pin line which is selected to cause a preselected resultant force on said second pin in response to said force exerted against said skeg.

8. The propulsion device of claim 7, wherein:

said first and second attachment points being configured to cause said second attachment point to completely disengage prior to said first attachment point in response to said force exerted against said skeg.

9. The propulsion device of claim 7, wherein:

said first and second attachment points are configured to cause said second attachment point to fracture prior to said first attachment point in response to said force exerted against said skeg.

10. The propulsion device of claim 7, wherein:

said second slot is a closed slot.

11. The propulsion device of claim 7, wherein:

said first pin is configured to move out of said first slot in response to said force exerted against said skeg.

12. A marine propulsion device, comprising:

a gear case;

a skeg;

a first attachment point connecting said gear case to said skeg; and a second attachment point connecting said gear case to said skeg, said first and second attachment points being configured to cause said second attachment point to completely disengage prior to said first attachment point in response to a force exerted against said skeg, said first attachment point comprising a first pin disposed in a first slot, said second attachment point comprising a second pin disposed in a second slot, said first and second attachment points being configured to cause said second attachment point to fracture prior to said first attachment point in response to said force exerted against said skeg, said first slot being a closed slot, said first pin being configured to move out of said first slot in response to said force exerted against said skeg, said first slot being configured to allow said first pin to slide along a first edge of said first slot, said first and second pins being disposed along a pin line and said first edge being disposed at an angle to said pin line which is selected to cause a preselected resultant force on said second pin in response to said force exerted against said skeg.

* * * * *